United States Patent [19]

Höller

[11] Patent Number: 4,715,285

[45] Date of Patent: Dec. 29, 1987

[54] ADDITIVE SEALING SLEEVE FOR LARGE-CALIBERED CANNON AMMUNITION FOR THE PROTECTION OF THE WEAPON BARREL

[75] Inventor: Roland Höller, Nuremberg, Fed. Rep. of Germany

[73] Assignee: Diehl GmbH & Co., Nuremberg, Fed. Rep. of Germany

[21] Appl. No.: 939,538

[22] Filed: Dec. 9, 1986

[30] Foreign Application Priority Data

Dec. 19, 1985 [DE] Fed. Rep. of Germany ..... 3544907

[51] Int. Cl.[4] ..... F42B 5/24

[52] U.S. Cl. ..... 102/435; 102/511

[58] Field of Search ..... 102/430, 435, 464, 511

[56] References Cited

U.S. PATENT DOCUMENTS 3,282,215 11/1966 Roth ..... 102/435

3,362,328 1/1968 Katz ..... 102/435

3,426,684 11/1969 Jacobson et al. ..... 102/435

*Primary Examiner*—Harold J. Tudor

*Attorney, Agent, or Firm*—Scully, Scott, Murphy & Presser

[57] ABSTRACT

An additive sealing or packing sleeve for large-calibered cannon ammunition, adapted for the protective treatment of the weapon barrel, which sleeve is constituted of a coated textile fabric which is assembled within a shell casing, in the form of a lining. The fabric is coated to provide a support or carrier for a mixture constituted of wax and titanium dioxide.

3 Claims, No Drawings

ADDITIVE SEALING SLEEVE FOR LARGE-CALIBERED CANNON AMMUNITION FOR THE PROTECTION OF THE WEAPON BARREL

BACKGROUND OF THE INVENTION

1. Field of the Invention

The present invention relates to an additive sealing or packing sleeve for large-calibered cannon ammunition, adapted for the protective treatment of the weapon barrel, which sleeve is constituted of a coated textile fabric which is assembled within a shell casing, in the form of a lining, wherein the fabric is coated to provide a support or carrier for a mixture constituted of wax and titanium dioxide.

In order to allow for the protection of the weapon barrel, so-called additive sealing sleeves are assembled within the shell casings. These sleeves are constituted of a fabric material forming a carrier or substrate which is coated with a mixture of wax and titanium dioxide. Upon firing, the additive sealing sleeve will combust or burn down, such that due to the melting off and the vaporization of the wax, there is formed a cooler layer on the wall of the barrel which protects the latter from the hot and corrosive combustion gases.

Thus, it has been ascertained that under the conditions of environmental experimentation at +63° C., there is encountered a partial melting and run-off of the mixture. Due to the liquid wax, the propellent powder is then contaminated, and there is obtained an undesired phlegmatization or desensitizing effect. This has as a consequence, that the gas pressure will drop off during firing as a result of the slowed down combustion of the powder.

The utilization of a wax possessing a higher melting point will lead to the sealing sleeve burning down only incompletely, and that solid residues will remain within the weapon barrel. This leads to an endangerment of the operating personnel or gun crews during the firing of subsequent shots.

2. Discussion of the Prior Art

From the disclosure of German Patent No. 27 09 247 there has known a process for the imparting of a predetermined life expectancy to a weapon barrel by means of a coating on the inner wall. For this purpose, there is contemplated that there be applied on the inner wall of the weapon barrel during manufacture thereof, a cooperating wear-resistant, high temperature-melting, and low heat-conductive coating. Through an addition of metallic oxides (preferably titanium dioxide), this coating is maintained at a thickness which will protect the barrel located therebelow from any damage censed by heat. This process does not come into consideration for the large-calibered artillery ammunition discussed herein, inasmuch as such coated barrels have presently not been introduced into use, and there is no permissible propellent powder available which can be replaced by the above-mentioned metallic oxides.

SUMMARY OF THE INVENTION

Accordingly, it is an object of the invention to so formulate the mechanical properties of the mixture, that the mixture will remain inherently stable at +63° C.

The foregoing object is inventively achieved in that the mixture contains a thickening medium which produces a stiffening or reinforced three-dimensional matrix or meshwork.

DETAILED DESCRIPTION

The inventively formed matrix or meshwork increases the viscosity of the mixture so intensely such that the additive sealing sleeve will remain mechanically inherently stable within the critical temperature range. Upon firing, the meshwork will break down without any difficulty due to the intense mechanical loading. Inasmuch as the meshwork is reversible, there is obtained that the processing can be implemented without any problems by means of the usual apparatuses, and wherein the melting down and combustion or burn-down behavior of the additive sealing material remains uninfluenced during firing.

A suitable additive is a polyolefin constituting the thickening medium.

The mixture according to the invention is constituted of a compound of wax and titanium dioxide, which is molten at a temperature of about 105° to 110° C., and then displaced by a polyolefin; for instance, comprising about 2% polybutylene and about 2% cellulose nitrate. These are carefully and uniformly admixed thereto. Hereby, the temperature of the mixture must lie above the melting point of the polyolefin which is employed. Thereafter, the compound is applied to the fabric which is utilized herein.

The thickening effect of the polybutylene can adversely affect the combustion or burn-down behavior of the sealing sleeve. The simultaneous addition of cellulose nitrate as an energy-providing substance will compensate for the foregoing.

What is claimed is:

1. Additive sealing sleeve for large-calibered artillery ammunition adapted for the protective treatment of a weapon barrel, said sleeve comprising a coated textile fabric which is assembled in a shell casing in the form of a lining, said fabric being covered as a support for a mixture constituted of wax and titanium dioxide; the improvement comprising in that the mixture contains a thickening medium which forms a stiffening three-dimensional meshwork, said thickening medium containing polybutylene and a combustion enhancing agent.

2. Additive sealing sleeve as claimed in claim 1, wherein the thickening medium comprises about 2% polybutylene and about 2% cellulose nitrate.

3. Additive sealing sleeve as claimed in claim 1, wherein the combustion enhancing agent is constituted of cellulose nitrate.

* * * * *